United States Patent [19]

Bailey

[11] Patent Number: 4,887,833

[45] Date of Patent: Dec. 19, 1989

[54] TOURING SKI BINDING

[76] Inventor: Mark R. Bailey, P.O. Box 1635, Frisco, Colo. 80443

[21] Appl. No.: 248,906

[22] Filed: Sep. 26, 1988

[51] Int. Cl.[4] ..... A63C 9/02

[52] U.S. Cl. ..... 280/615; 280/618; 280/620; 280/633

[58] Field of Search ..... 280/614, 615, 617, 618, 280/619, 620, 621, 622, 633, 635, 636

[56] References Cited

U.S. PATENT DOCUMENTS

| | | | |
|---|---|---|---|
| Re. 27,991 | 4/1974 | Von Besser | 280/618 |
| 2,094,667 | 10/1937 | Parish | 280/611 |
| 2,758,846 | 8/1956 | Swensen | 280/611 |
| 3,055,673 | 9/1962 | Marker | 280/622 |
| 3,305,242 | 2/1967 | Marker | 280/622 |
| 3,851,892 | 12/1974 | Swenson | 280/615 |
| 3,905,612 | 9/1975 | Kjellstrom | 280/635 X |
| 4,050,716 | 9/1977 | Kubelka et al. | 280/614 |
| 4,088,342 | 5/1978 | Hausleithner | 280/633 X |
| 4,134,603 | 1/1979 | Zoor | 280/614 |
| 4,142,734 | 3/1979 | Bentley | 280/615 |
| 4,188,045 | 2/1980 | Marker | 280/614 |
| 4,288,093 | 9/1981 | Krob et al. | 280/636 X |
| 4,322,090 | 3/1982 | Loughrey | 280/614 |

FOREIGN PATENT DOCUMENTS

| | | | |
|---|---|---|---|
| 2374059 | 8/1978 | France | 280/615 |
| 2572943 | 5/1986 | France | 280/614 |

*Primary Examiner*—Charles A. Marmor
*Assistant Examiner*—Brian L. Johnson
*Attorney, Agent, or Firm*—Edwin L. Spangler, Jr.; Richard W. Hanes

[57] ABSTRACT

The disclosure relates to a cross country ski binding having a triple-leaved hinge interconnecting a fixed toeplate and a heelplate detachably connected to the boot heel characterized in that as the boot is bent at the ball of the foot and lifted off the ski carrying with it the heelplate thereby lengthening the distance separating the latter from the toeplate, a yieldable spring-biased connection becomes operative to permit these elements to spread apart without materially retarding or otherwise interfering with the skier's freedom of lifting the boot and setting it back down again to initiate and complete the cross country glide while, at the same time, providing the lateral stability necessary for effectively edging the skis in the downhill mode. The invention also encompasses certain novel features present in a yieldable self-adjusting heel holdown subassembly.

5 Claims, 2 Drawing Sheets

TOURING SKI BINDING

BACKGROUND OF THE INVENTION

In the past there were two basically different types of skiing, one known as "downhill" and the other as "cross country" or, alternatively, "touring". Downhill skiing involves negotiating relatively steep slopes and getting up the mountain on some kind of T-bar, chair or gondola-equipped tow. Touring, on the other hand, is generally confined to flatter ground where no tow is required and the skier is free to go more or less wherever he or she wishes. While slight changes in the terrain are encountered, for the most part the hills are nowhere near as steep as found in downhill skiing even on the very easy runs.

As one might expect, not only does the terrain differ but the equipment and the techniques used are quite different from one another. Downhill skiing, for the most part, requires the skier to wear very stiff, high-topped boots made of plastic rather than leather and which allow for very little ankle movement. The skis are wide, especially contoured and cambered, and steel-edged so that the turns can be "carved" even in hard-packed snow. Even the poles are shorter and oftentimes have what is known as "baskets" of different design. Racers even use crooked poles where the baskets come close together behind the back thus cutting down wind resistance. High speeds are commonplance and the equipment permits one to turn quickly and accurately on even bumpy terrain laced with so-called "moguls" carved by expert skiers following the same track and wearing away the snow to produce tracks made up of successive turns, first one way and then another. For all practical purposes, almost no energy is expended in getting from one place to another on the mountain, just in the maneuvering in between.

By way of contrast, in cross country skiing, a great deal of energy is expended in getting where one wishes to go and very little in the turning, jumping and control of one's speed. The technique involves alternately pushing off with one ski and then the other with long gliding strides in between. To facilitate this gliding technique, the boots are very pliable, almost like bedroom slippers and the skis are long and quite narrow to lessen the weight and the resistance. The bindings unlike those used on downhill skis which tightly fasten the whole boot to the ski, are ones which make the connection with the ski only at the tip of the toe, usually with a set of three upstanding pins that fit into corresponding holes in the sole of the boot. The net result is that cross country skis, boots and bindings are ill-suited for downhill skiing because there is so little control that can be transferred from the foot to the ski through the minimal connection between the boot and binding so necessary for performing the proper glide over relatively level terrain.

In recent years, however, an increasing number of skiers have taken to a combination of the two types of skiing where cross country skis are being used in a downhill environment. Unfortunately, for all but the most expert of the skiers, the cross country equipment ordinarily used is totally inadequate to make the turns at a much higher speed on a steep hill that becomes a simple matter for a downhill skier of even minimal skill to execute with downhill equipment. The equipment differences are such that even the technique of executing a turn is unique and cells for what is known as a "telemark" turn to be made on cross country skis where the tip of the trailing ski lies alongside the foot secured to the lead ski which is maneuvered much like a rudder.

A need exists, therefore, for a better way of transferring the turning motion of the foot and ankle to the ski than is presently available without, at the same time, interfering with the forward flexibility so necessary for gliding over relatively flat terrain. Certain high-topped, but stiff-soled, flexible leather boots offer a partial solution to the control problem, however, much needs to be done in terms of a proper binding.

1. Field of the Invention

The present invention relates to a novel and improved binding for use with cross country skis that provides the degree of control necessary when skiing steep terrain, yet which retains the flexibility required for gliding over and even up gentle slopes found in relatively flat country.

2. Description of the Related Art

The U.S. Pat. No. 4,142,734 to Bentley shows a flexible sole plate attached to the ski at the toe with no provision being made, at least in the binding itself, for the heelplate to move relative to the toe plate thus accommodating the fact that they will tend to move closer together as the heel is lifted. The Marker combination downhill and cross country binding shown in his U.S. Pat. No. 4,188,045, like that of Bentley, makes no provision for the heel connector to move relative to the toe-piece when the heel is raised off the soleplate. In the cross country version of Zoor's binding shown in his Patent No. 4,134,603, there is only one transverse axis aboout which the heel lifts and it is forwardly of the toe. There is no axis of pivotal movement under the ball of the foot. Parish's U.S. Pat. No. 2,094,667, on the other hand, shows a transverse axis at the ball of the foot and none at the toe. It appears that the distance separating the heel connection and the aforementioned axis of pivotal movement remains fixed.

Swensen's binding shown in his Patent No. 2,758,846 allows the skier to shift the transverse hinge axis forwardly underneath the ball of the foot for touring and back underneath the heel for downhill skiing where the boot should not raise off the ski. Once adjusted, however, the tongue interconnecting the heel and toe pieces apparently does not move thus maintaining a fixed separation therebetween. The Kubelka et al Patent No. 4,050,716 employs a specially-designed two part ski boot in which the base portion is pinned by means of a transversely-extending pair of pins to a baseplate set on the ski. When used in the cross country mode, the heel connection to the boots ankle-encircling cuff is disconnected and the boot is permitted to rock forward to a limited degree about the single axis of pivotal movement defined by these pins. It appears that the cuff can also pivot relative to the toe-engaging portion of the boot about an axis at about the skier's ankle bone thus providing a second axis of pivotal movement located behind the first but forming no part of the binding.

The Loughney Patent No. 4,322,090 shows a combination downhill, cross country and so-called "alpine touring" ski binding which in the cross country or alpine touring mode functions much like that of the Zoor patent previously described in that the soleplate attached to the boot lifts and pivots about a single axis at the toe. Of all the prior art patents known to applicant, the closest would appear to be that of Hausleithner No. 4,088,342 which also shows a combination cross country and downhill binding, but one having two transverse axes of pivotal movement, one at the toe and a second in the area of the ball of the foot. The spacing between the aforementioned second axis of pivotal movement and the heelpiece, while adjustable, appears to remain fixed once adjusted to accommodate the skier's boot. No provision is made for yieldably elongating the portion of the binding between this second axis of pivotal movement and the heelpiece as the boot bends at the ball of the foot nor does it appear to be necessary in that the boot does not appear to bend in this area, but rather, be of the stiff-soled downhill type.

SUMMARY OF THE INVENTION

The present invention relates to an improved ski binding for alpine touring which in cooperation with a high-topped but soft boot provides the lateral stability along with the longitudinal flexibility so necessary in the execution of controlled turns on a steep hill using cross country skis. It employs double hinge axes, one at the toe and a second underneath the instep which allow not only the heel to raise off the ski but the ball of the foot as well, and in addition, it permits the foot to bend at the ball of the foot thus facilitating the gliding action required when traversing leveler terrain and in going up slight grades. Of special significance is the yieldable connection between the second of the hinge axes and the heelpiece which permits the sole of the boot to move from a near straight-line to a much more angled relation with the heel and toepieces still connected to the boot, this being a feature heretofore attainable only by disconnecting the heelpiece with the attendant loss of lateral stability in the heel area.

It is, therefore, the principal object of the present invention to provide a novel and improved binding for cross country skis that renders them much more suitable for alpine touring down steep terrain where a greater degree of control is required than along leveler ground where only gentle dips and rises need to be traversed.

A second objective is to provide a device of the type aforementioned which can be used with the presently existing cross country skis and boots without modification.

Another object of the invention herein disclosed and claimed is to provide a binding which in no way lessens or interferes with the flexibility required for ordinary cross country skiing while, at the same time, considerably broadening its utility by making the cross country equipment useful in downhill applications.

Still another objective of the within-described invention is that of providing a double-hinged alpine binding for use on cross country skis that provides improved torsional rigidity.

An additional object is to provide a ski binding of the class described which does not have to be remounted in order to accommodate boots of different sizes since only the toeplate is fastend to the ski.

Further objects are to provide a ski binding for use in both cross country and alpine skiing which is relatively simple, easy to use, versatile and yet provides the skier with an excellent means for transferring his or her leg and ankle movements through the boots to the skis.

Other objects will be part apparent and in part pointed out specifically hereinafter in connection with the drawings that follows.

DESCRIPTION OF THE PREFERRED EMBODIMENTS

Figures 1, 2, 3:
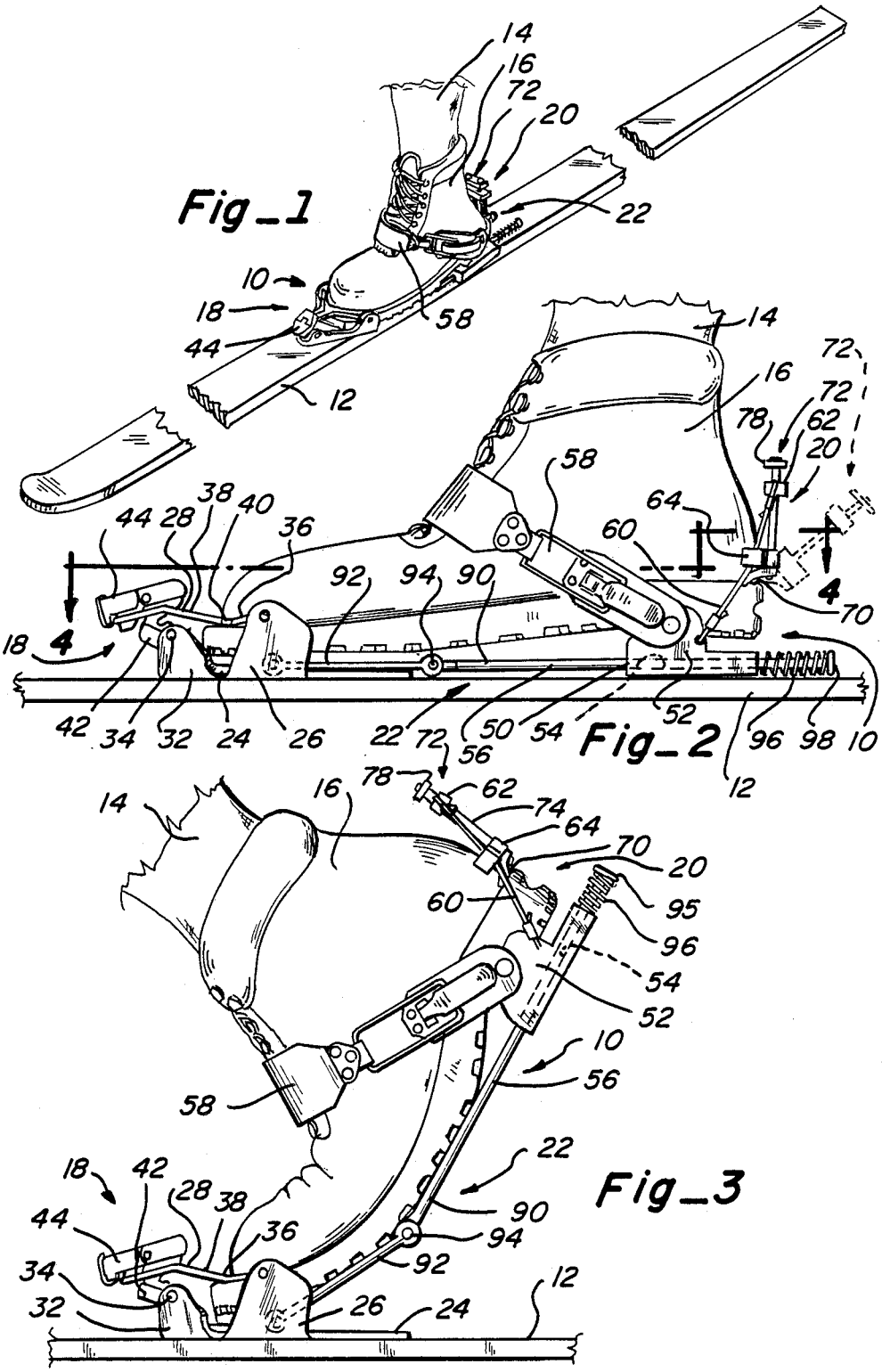
FIG. 1 is a perspective view with portions broken away to conserve space showing the ski binding of the present invention installed and in use upon a cross country ski.
FIG. 2 is a fragmentary side elevation to a much enlarged scale showing the ski, binding and boot resesting upon the ski.
FIG. 3 is a fragmentary side elevation to the same scale as FIG. 2 but showing the boot and binding in the raised position they would occupy as the skier pushes off into this or her glide.

Referring to the drawings for a detailed description of the present invention, reference numeral 10 has been selected to identify the ski binding broadly and it will be seen mounted on a cross country or touring ski 12. A skier 14 is shown wearing a high-topped ski boot 16 of the type which will flex and bend at the sole in the manner seen in FIG. 3; yet, will resist lateral flexation so that adequate edge-control over the skis can be maintained through the connection between the boot, binding and ski.

Binding 10 comprises a toe subassembly, a heel subassembly and a double-hinged sole supporting subassembly connecting the two, these subassemblies having been broadly designated by reference numerals 18, 20 and 22, respectively. In the particular form shown, the toe subassembly 18 includes a toeplate 24 which is screwed to the top of the ski in the conventional manner. An integrally-formed upstandinyg pair of widespread ears 26 are located in opposite sides of the toeplate and angled slightly to receive the tapered toe of the boot functioning in the well known manner to confine the latter and keep it in proper position atop the ski. These same ears mount a pivotally-movable generally Y-shaped wire bail 28 of conventional design which swings down from the released position shown in FIG. 4 to the engaged position shown in the remaining figures to engage the sole of the boot alongside and around the toe and hold it down onto the upstanding pins 30 which stick up from the toeplate and enter the apertures in the bottom of the boot (not shown). Just ahead of ears 26 and centered therebetween are a second closely-spaced pair of upstanding integrally-formed ears 32 which mount a transversely-extending latch pin 34. The divergent legs 36 of the bail 28 are what rest atop the sole of the boot and hold it down onto the pins 30 while the stem-forming portion 38 projects forwardly when in closed position to overlie the latch pin. Stem-forming portion 38 of the wire bail is bifurcated as shown most clearly in FIG. 4, with the bifurcated sections being held in fixed spaced relation by a connector 40. The free end of the stem-forming portion is provided with a hook-type connector 42 adapted to engage the latch pin and hold the bail closed upon actuation of eccentrically-mounted latch member 44. A more detailed description of the toe subassembly 18 and the manner in which it functions upon actuation to fasten and hold the toe of the boot down onto the top of the ski and prevent it turning from side-to-side by virtue of the pinned connection therebetween would serve no useful purpose since such toe-holddown subassemblies are in common use on cross country ski bindings. These is one significant difference, however, and that is the presence of a front hinge pin 46 which is mounted on the toeplate 24 to extend transversely thereof in spaced relation behind the pins 30 and below the bail 28. It is to this hinge pin that the front leaf of the sole-supporting subassembly 22 is hingedly attached; however, before getting into details of the latter subassembly which is the most novel aspect of the present invention, it is best to first focus attention on the heel subassembly 20.

Functionally this heel holddown subassembly does some of the same things that a downhill binding does, namely, preventing any lateral movement of the heel of the boot relative to the ski thereby facilitating the transfer of control movements between the skier's foot and ankle to the ski. In most downhill bindings, however, the heel of the boot is not allowed to raise up off the ski unless an emergency occurs in which the release feature of the binding comes into play. In the binding forming the subject matter of the instant invention, on the other hand, one of its principal features is leaving the boot free to raise up off the ski and bend at both the toe and the ball of the foot. Thus, while the heel of the boot is securely fastened to the sole-supporting subassembly 22 interconnecting it to the toe subassembly, nevertheless, the boot and ankle are left free to flex and bend in a vertical plane as well be explained in detail presently.

Figure 4:
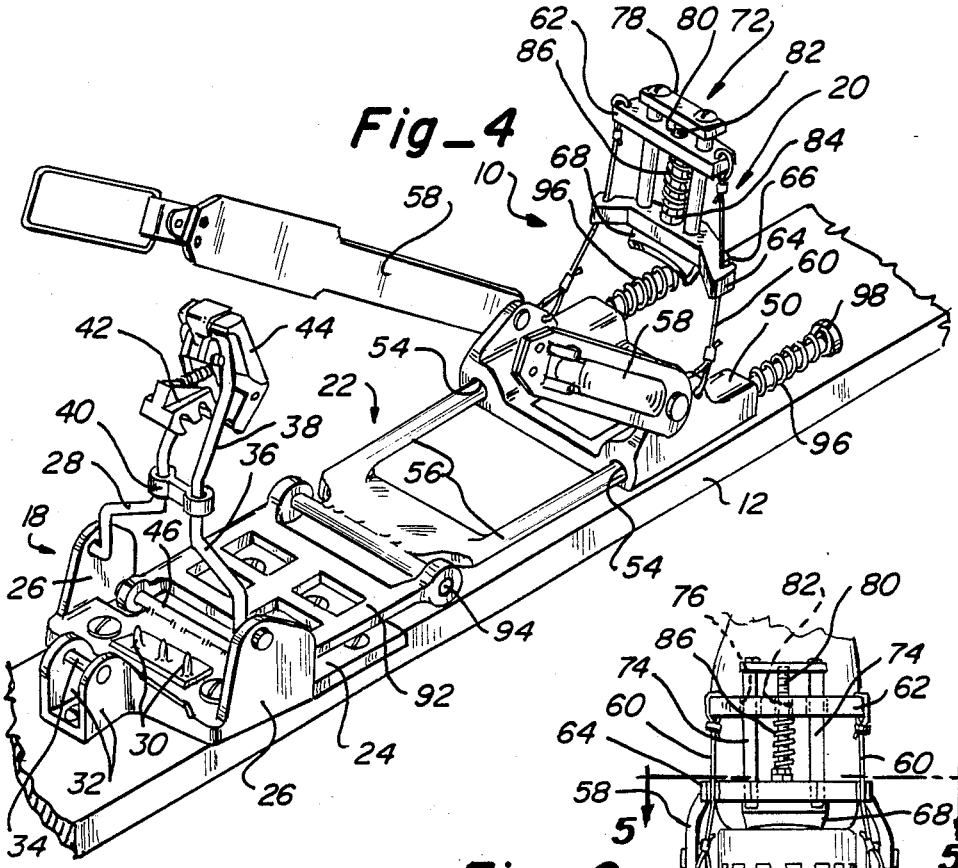
FIG. 4 is a fragmentary perspective view to the same scale as FIGS. 2 and 3 showing the binding mounted upon the ski and ready to receive the boot.
Figure 5:
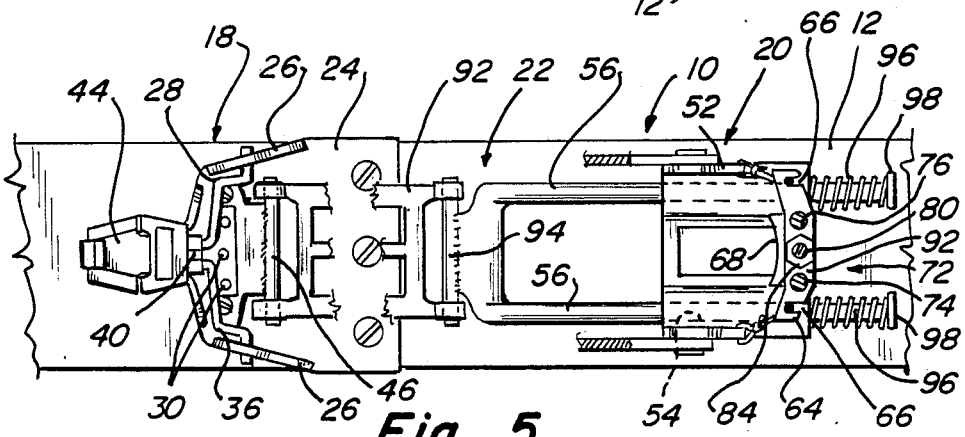
FIG. 5 is a fragmentary top plan view of a ski with the binding of the present invention attached with a portion thereof broken away and shown in cross section along lines 5—5 of FIG. 6.

This heel holddown subassembly 20 differs from the subassembly 18 at the toe in that it does, in face, embody certain novel structural features not found in other bindings, be they cross country or downhill ones. A heelplate 50 sits atop the ski spaced well behind the toeplate 24 and lies in supporting relation underneath the heel of the boot. The side margins of the plate 50 are provided with integrally-formed upstanding ears 52 which confine the side margins of the boot sole and keep it centered atop the ski in the same manner as ears 26 do at the front of the boot. Ears 52 however, unlike their counterparts 26, need not be angled relative to one another but instead are best left essentially parallel so as to include transversely-spaced parallel bores 54 within which the track means or rails 56 of the sole-supporting subassembly 22 slide and reciprocate. A conventional two-part ankle strap 58 is attached for pivotal movement to these ears in position to loop over the instep. Such a strap not only provides somewhat improved lateral stability, but, in addition, it cooperates with the heel subassembly 20 to keep the boot heel in fixed position atop the heelplate 50. Spaced rearwardly of the pivotal connection of the ankle strap to the ears 52 will be found apertures into which are connected the lower ends of a pair of cables 60. The upper ends of these cables are similarly fastened to a crossbar 62 that is positioned behind the heel of the boot spaced well above its sole. Positioned between this crossbar and the heelplate is a heel-holddown member 64 which carries a pair of rearwardly-facing slots 66 adjacent its opposite ends through which the cables 60 are reaved as shown in FIGS. 4 and 5. This holddown element is more or less arcuately shaped to rather snugly engage the heel of the boot while providing a forwardly and downwardly-extending torque 68 intermediate its ends which has shaped to fit into the notch 70 formed where the heel of the boot meets its sole.

Figure 6:
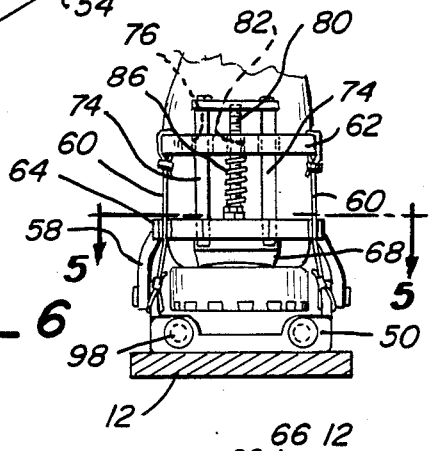
FIG. 6 is a fragmentary rear elevation to an enlarged scale showing the yieldable spring-biased self-adjusting mechanism which accommodates different boot sole thicknesses and facilitates fastening and removal of the binding, portions of which have been broken away and shown in section.

It will be apparent from an examination of FIG. 2 that with the ankle strap 58 fastened across the instep of the boot, it cannot lift free of the heelplate 50 although it could slide to the rear. A connection between the heel-holddown element and the heelplate is desirable because it works on convert with the ankle strap to prevent the heel of the boot from sliding to-and-fro along the heelplate. Accordingly, a spring-biased self-adjusting mechanism which has been indicated in a general way by reference numeral 72 is used to form the yieldable connection between the heel-holddown element and crossbar 62. The details of this adjustment mechanism can be seen most clearly in FIGS. 4, 5 and 6 to which detailed reference will now be made.

A pair of guiderods 74 arranged in transversely-spaced parallel relation atop the heel-holddown member 64 pass upwardly through a pair of openings 76 in the crossbar 62 where their upper projecting ends are connected together by crosslink 78. Heel-holddown member 64 crosslink 78 and the two guiderods 74 interconnecting the two, and which maintain a fixed spaced relation therebetween, all cooperate to define a rectangular subassembly which is free to move up and down cables 60 thus changing the position of the heel-holddown element relative to crossbar 62 and to heelplate 50. Thus, as the heel-holddown element 64 is raised and lowered on cables 60 to the level where the tongue 68 is in proper position to enter the boat notch 70 and hold the boot down onto the heelplate, these guiderods move up and down relative to the crossbar 62, however, some means must also be provided for biasing the tongue 68 down against the sole of the boot, thus forcing the sole into contact with the heelplate 50. In the particular form shown such means comprises a threaded rod 80 non-rotatably mounted between the opposed surfaces of the heel-holddown element 64 and the cross link 78 which is fastened within an opening 82 in the crossbar, a nut 84 on rod 80 which screws up and down the latter between the heel-holddown element and the crossbar as shown most clearly in FIG. 6, and a compression spring 86 mounted on threaded rod 80 between the nut and the crossbar for biasing the heel-holddown element into the notch and against the boot sole. Thus, regardless of the thickness of the boot sole, in order to fasten the heel subassembly 20, it is only necessary to insert the tongue 68 in the notch 70 and raise the adjusting mechanism 72 up from the phantom line into the full line position shown in FIG. 2. In so doing, spring 86 will yield and permit the heel-holddown element to raise up slightly as the self-adjusting mechanism 72 moves over center with a toggle action and snaps into place. Then, when the time comes to release the heel subassembly from the boot, it is only necessary to reverse the process and tilt the adjustment mechanism from its full line latched position of FIG. 2 into its released position shown in phantom lines. For thin-soled boots, it may be necessary to increase the pressure on the heel-holddown element so that it will hold the heel down tightly against the heelplate. This is simply accomplished by threading nut 84 up the threaded rod 80 thereby increasing compression in spring 86.

From the foregoing it can be seen that not only is the toe of the boot held in fixed position by the pins 30, but, in addition, the heelplate 50 of the boot remains in fixed position on the sole thereof due to the ankle strap preventing it from moving rearwardly and the heel holddown subassembly 20 keeping it from moving forwardly. There remains, however, a unique problem to be solved, namely, the change in the spacing that takes place between the heel and toe subassemblies as the boot is flexed from its position flat atop the ski shown in FIG. 2 into its fully raised position shown in FIG. 3. Due to the bending of the boot, the straightine distance from a given point on the toeplate to another point selected on the heelplate increases substantially as the boot is flexed between its FIG. 2 and FIG. 3 positions. Actually, this distance can increase as much as nearly an inch with large size ski boots. Obviously, if the spacing between the heel and toe subassemblies was to remain fixed and, as previously noted, each of these subassemblies was fixed in its relation to the boot sole, then the whole assembly would be in such a state that the boot would not be able to move up or down with respect to the ski since there would be nothing to accommodate this elongation and foreshortening. If, therefore, the skier was prevented by the binding from raising his or her boot freely off the ski into the FIG. 3 position and then returning it to a position resting atop thereof, the whole technique of pushing off and gliding that is so essential to good cross country skiing would be thwarted.

Applicant has solved this problem by making the sole-supporting subassembly 22 elongatable. The previously-described rails 56 comprise elements of the rear hinge leaf 90 which is hingedly connected to front leaf 92 by means of transversely-extending hinge pin 94. The latter hinge pin, in the particular form shown, comprises an integral part of the rear hinge leaf and is located as seen in FIGS. 2 and 3 underneath the ball of the foot where the foot and boot first bend as the heel is raised off the ski. When the skier first "pushes off" and he or she lunges forward into a glide, the boot of the foot which is pushing off is initially flat on the ski as seen in FIG. 2. The first thing that happens is that the rear hinge leaf and associated heel-holddown subassembly 20 raises off the ski as the other leg moves ahead of the first into the so-called "stride". In the meantime, the ball of the foot and toes have remained flat atop the toeplate 24 as has the front hinge leaf 92. Finally, as the stride lengthens out and the legs move farther apart to complete the gliding motion, the front hinge leaf along with the ball of the foot will also raise up off the ski as shown in FIG. 3. It is these actions which must remain unhampered by the binding 10 while, at the same time, maintaining the lateral stability necessary to "edge" and properly control the thin cross country skis when being used in the downhill mode. These same movements cause the heel-holddown subassembly 20 to move away from the toe-holddown subassembly 18 thus necessitating the spring-biased yieldable coupling provided by subassembly 22 currently being described. To accommodate this lengthening of the space between the heel and toe subassemblies, the rails 56 which are slidably received within the parallel bores 54 in the heelplate 50 act as a track upon which the heelplate 50 may slide rearwardly against the force of the compression springs 96 positioned on the portions thereof located between the rear edge of the heelplate 50 and integrally-formed abutments 98 on the rear ends of the rails 56. The extension of these rails and the resulting compression of springs 96 accompanying the raising of the boot off the ski can be seen most clearly in FIG. 3 where it is evident that considerable elongation takes place. By accommodating this elongation while, at the same time, using two hinge axes, one in the toe area and a second therebehind in the area of the ball of the foot, the natural "pushing-off" action that the skier's foot makes when striding forward into the glide so necessary when using the proper technique in cross country skiing is greatly facilitated.

What is claimed is:

1. A binding for attaching a boot to a ski, comprising:

a toeplate adapted for attachment to the ski and having means for releasably clamping and laterally securing the toe of the boot to the ski;

a heelplate;

means carried by the heelplate for detachably clamping the heelplate to the heel portion of the boot;

a first laterally rigid hinge leaf pivotally attached to the toeplate for hinged movement about a first transverse axis underlying the toe of the boot;

a second laterally rigid hinge leaft comprising track means longitudinally aligned with the ski and pivotally attached to the first hinge leaf for hinged movement about a second transverse axis which is parallel to the said first tranverse axis and spaced therefrom so that the second axis underlies that portion of the boot containing the ball of the foot;

means slidably interconnecting the heelplate and the track means to provide for relative longitudinal movement toward and away from said second transverse axis to accommodate a longitudinal spreading apart of the heelplate and toeplate as the boot is bent at the ball of the foot raising the heel of the boot off the ski; and biasing means carried by the track means and operable to normally slide the heelplate toward the toeplate.

2. The ski binding as set forth in claim 1 in which: the means for detachably clamping the heelplate to the heel of the boot comprises an ankle strap and means for releasably clamping the heel of the boot to the heelplate cooperating with one another to prevent relative longitudinal movement between said boot heel and heelplate.

3. The ski binding as set forth in claim 1 in which: the heelplate includes a pair of longitudinally-extending transversely-spaced parallel bores, wherein the track means includes a pair of rails slidably received within the bores, said rails projecting rearwardly beyond the heelplate and terminating in means defining spring abutments, and in which the biasing means comprise a pair of compression springs mounted on the rails between the heelplate and the spring abutments.

4. The ski binding as set forth in claim 1 in which: the toeplate and first and second hinge leaves cooperate to define a triple-leaved hinge movable in a plane normal to the ski while resisting sidewise or torsional deflection relative thereto.

5. The ski binding as set forth in claim 2 in which: the means for releasably attaching the boot heel to the heelplate further comprises a transversely-extending crossbar, a pair of cables connecting opposite ends of the crossbar to the heelplate on opposite sides of the boot, a heel holddown member contoured to fit the heel of the boot, said holddown member having rearwardly-opening slots positioned and adapted to slidably receive the cables, and means comprising a compression spring mounted between said crossbar and holding member normally biasing the latter into contact with the heel of the boot.

* * * * *